US010371142B2

(12) United States Patent
Mills

(10) Patent No.: US 10,371,142 B2
(45) Date of Patent: Aug. 6, 2019

(54) METHODS AND APPARATUS FOR PAIRING ROD PUMP CONTROLLER POSITION AND LOAD VALUES

(71) Applicant: Bristol, Inc., Watertown, CT (US)

(72) Inventor: Thomas Matthew Mills, Katy, TX (US)

(73) Assignee: BRISTOL, INC., Houston, TX (US)

( * ) Notice: Subject to any disclaimer, the term of this patent is extended or adjusted under 35 U.S.C. 154(b) by 439 days.

(21) Appl. No.: 14/810,045

(22) Filed: Jul. 27, 2015

(65) Prior Publication Data

US 2017/0030348 A1 Feb. 2, 2017

(51) Int. Cl.

| | |
|---|---|
| ***F04B 51/00*** | (2006.01) |
| ***E21B 43/12*** | (2006.01) |
| ***F04B 53/14*** | (2006.01) |
| ***E21B 47/00*** | (2012.01) |

(52) U.S. Cl.

CPC ..... *F04B 51/00* (2013.01); *E21B 43/121* (2013.01); *E21B 43/127* (2013.01); *E21B 47/0008* (2013.01); *F04B 53/144* (2013.01)

(58) Field of Classification Search

CPC ..... F04B 51/00; E21B 43/121; E21B 43/127
USPC ..... 702/60
See application file for complete search history.

(56) References Cited

U.S. PATENT DOCUMENTS

| | | | | |
|---|---|---|---|---|
| 4,490,094 | A | 12/1984 | Gibbs | |
| 9,080,438 | B1 * | 7/2015 | McCoy | E21B 47/18 |
| 2006/0149476 | A1 | 7/2006 | Gibbs et al. | |
| 2009/0311107 | A1 * | 12/2009 | Chavez Zapata | F04B 47/02 417/12 |
| 2012/0020808 | A1 | 1/2012 | Lawson et al. | |
| 2013/0115107 | A1 * | 5/2013 | Pons | F04B 49/065 417/42 |
| 2013/0333880 | A1 * | 12/2013 | Raglin | E21B 47/0007 166/250.01 |
| 2015/0142319 | A1 * | 5/2015 | McCoy | E21B 47/0007 702/9 |
| 2015/0300156 | A1 | 10/2015 | Mills | |
| 2015/0345280 | A1 * | 12/2015 | Krauss | E21B 43/127 700/282 |
| 2017/0002635 | A1 * | 1/2017 | Williams | E21B 43/127 |

OTHER PUBLICATIONS

International Search Authority, "International Search Report," issued in connection with International Patent Application No. PCT/US2016/044368, dated Oct. 24, 2016, 4 pages.
International Search Authority, "Written Opinion," issued in connection with International Patent Application No. PCT/US2016/044368, dated Oct. 24, 2016, 6 pages.

* cited by examiner

*Primary Examiner* — Ricky Ngon
(74) *Attorney, Agent, or Firm* — Hanley, Flight & Zimmerman, LLC

(57) ABSTRACT

Methods and apparatus for pairing load and position values are disclosed. An example method includes determining, via a rod pump controller, a first position value of a polished rod of a pumping unit, assigning a first time value to the determined first position value, receiving first load values of the polished rod, assigning second time values to respective ones of the first load values, adjusting each of the second time values to respective third time values based on a wireless communication delay value, and determining a second load value associated with the first position value at the first time value based on the first load values and the third time values.

35 Claims, 6 Drawing Sheets

308

| 312 time [sec] | 304 new polished rod position value [inch] | 306 new load cell value [lbs] | 310 Biased Load Cell Values [lbs] |
|---|---|---|---|
| 0.035 | | | 10234 |
| 0.05 | 14.75 | | 0 |
| 0.055 | | 10234 | 0 |
| 0.085 | | | 10456 |
| 0.1 | 15.78 | | 0 |
| 0.105 | | 10456 | 0 |
| 0.135 | | | 11657 |
| 0.15 | 17.65 | | 0 |
| 0.155 | | 11657 | 0 |
| 0.185 | | | 12232 |
| 0.2 | 20.23 | | 0 |
| 0.205 | | 12232 | 0 |
| 0.235 | | | 12111 |
| 0.25 | 23.01 | | 0 |
| 0.255 | | 12111 | 0 |
| 0.285 | | | 12281 |
| 0.3 | 25.88 | | 0 |
| 0.305 | | 12281 | 0 |
| 0.335 | | | 13042 |
| 0.35 | 27.53 | | 0 |
| 0.355 | | 13042 | 0 |
| 0.385 | | | 11983 |
| 0.4 | 30.11 | | 0 |
| 0.405 | | 11983 | 0 |
| 0.435 | | | 11763 |
| 0.45 | 33.89 | | 0 |
| 0.455 | | 11763 | 0 |
| 0.485 | | | 12028 |
| 0.5 | 37.87 | | |
| 0.505 | | 12028 | |

FIG. 3B 302 304 306

300

| time [sec] | new polished rod position value [inch] | new load cell value [lbs] |
|---|---|---|
| | | |
| 0.05 | 14.75 | |
| 0.055 | | 10234 |
| 0.1 | 15.78 | |
| 0.105 | | 10456 |
| 0.15 | 17.65 | |
| 0.155 | | 11657 |
| 0.2 | 20.23 | |
| 0.205 | | 12232 |
| 0.25 | 23.01 | |
| 0.255 | | 12111 |
| 0.3 | 25.88 | |
| 0.305 | | 12281 |
| 0.35 | 27.53 | |
| 0.355 | | 13042 |
| 0.4 | 30.11 | |
| 0.405 | | 11983 |
| 0.45 | 33.89 | |
| 0.455 | | 11763 |
| 0.5 | 37.87 | |
| 0.505 | | 12028 |

FIG. 3A

314

| 312 time [sec] | 304 new polished rod position value [inch] | 306 new load cell value [lbs] | 310 Biased Load Cell Values [lbs] | 316 Linearly-interpolated Load cell "pseudo-measurements" [lbs] |
|---|---|---|---|---|
| 0.035 | | | 10234 | |
| 0.05 | 14.75 | | 0 | 10301 |
| 0.055 | | 10234 | 0 | |
| 0.085 | | | 10456 | |
| 0.1 | 15.78 | | 0 | 10816 |
| 0.105 | | 10456 | 0 | |
| 0.135 | | | 11657 | |
| 0.15 | 17.65 | | 0 | 11830 |
| 0.155 | | 11657 | 0 | |
| 0.185 | | | 12232 | |
| 0.2 | 20.23 | | 0 | 12196 |
| 0.205 | | 12232 | 0 | |
| 0.235 | | | 12111 | |
| 0.25 | 23.01 | | 0 | 12162 |
| 0.255 | | 12111 | 0 | |
| 0.285 | | | 12281 | |
| 0.3 | 25.88 | | 0 | 12509 |
| 0.305 | | 12281 | 0 | |
| 0.335 | | | 13042 | |
| 0.35 | 27.53 | | 0 | 12724 |
| 0.355 | | 13042 | 0 | |
| 0.385 | | | 11983 | |
| 0.4 | 30.11 | | 0 | 11917 |
| 0.405 | | 11983 | 0 | |
| 0.435 | | | 11763 | |
| 0.45 | 33.89 | | 0 | 11843 |
| 0.455 | | 11763 | 0 | |
| 0.485 | | | 12028 | |
| 0.5 | 37.87 | | | |
| 0.505 | | 12028 | | |

FIG. 3C

METHODS AND APPARATUS FOR PAIRING ROD PUMP CONTROLLER POSITION AND LOAD VALUES

FIELD OF THE DISCLOSURE

This disclosure relates generally to rod pump controllers and, more particularly, to methods and apparatus for pairing rod pump controller position and load values.

BACKGROUND

Pumping units are used to operate downhole pumps that pump oil from an oil well. In some instances, a rod pump controller collects data during operation of a pumping unit to generate dynamometer cards that assist in determining the performance of the pumping units and its associated components.

SUMMARY

An example method disclosed herein includes determining, via a rod pump controller, a first position value of a polished rod of a pumping unit, assigning a first time value to the determined first position value, receiving first load values of the polished rod, assigning second time values to respective ones of the first load values, adjusting each of the second time values to respective third time values based on a wireless communication delay value, and determining a second load value associated with the first position value at the first time value based on the first load values and the third time values.

An example rod pump controller includes a first processor to determine, via a rod pump controller, a first position value of a polished rod of a pumping unit; assign a first time value to the first position value; receive first load values of the polished rod; assign second time values to respective ones of the first load values; adjust each of the second time values to respective third time values based on a wireless communication delay value; and determine a second load value associated with the first position value at the first time value based on the first load values and the third time values.

An example tangible computer-readable medium has instructions that, when executed, cause a machine to: determine, via a rod pump controller, a first position value of a polished rod of a pumping unit; assign a first time value to the first position value; receive first load values of the polished rod; assign second time values to respective ones of the first load values; adjust each of the second time values to third time values based on a wireless communication delay value; and determine a second load values associated with the first position value at the first time value based on the first load values and the third time values.

BRIEF DESCRIPTION OF THE DRAWINGS

FIG. 3A shows an example reference table generated prior to the example apparatus of FIG. 1 synchronizing and pairing position and load values of a polished rod.

FIG. 3B depicts another example reference table generated by the example apparatus of FIG. 1 accounting for wireless communication delay.

FIG. 3C shows an example reference table generated by the example apparatus of FIG. 1 in accordance with the teachings of this disclosure.

The figures are not to scale. Wherever possible, the same reference numbers will be used throughout the drawing(s) and accompanying written description to refer to the same or like parts.

DETAILED DESCRIPTION

Figure 1:
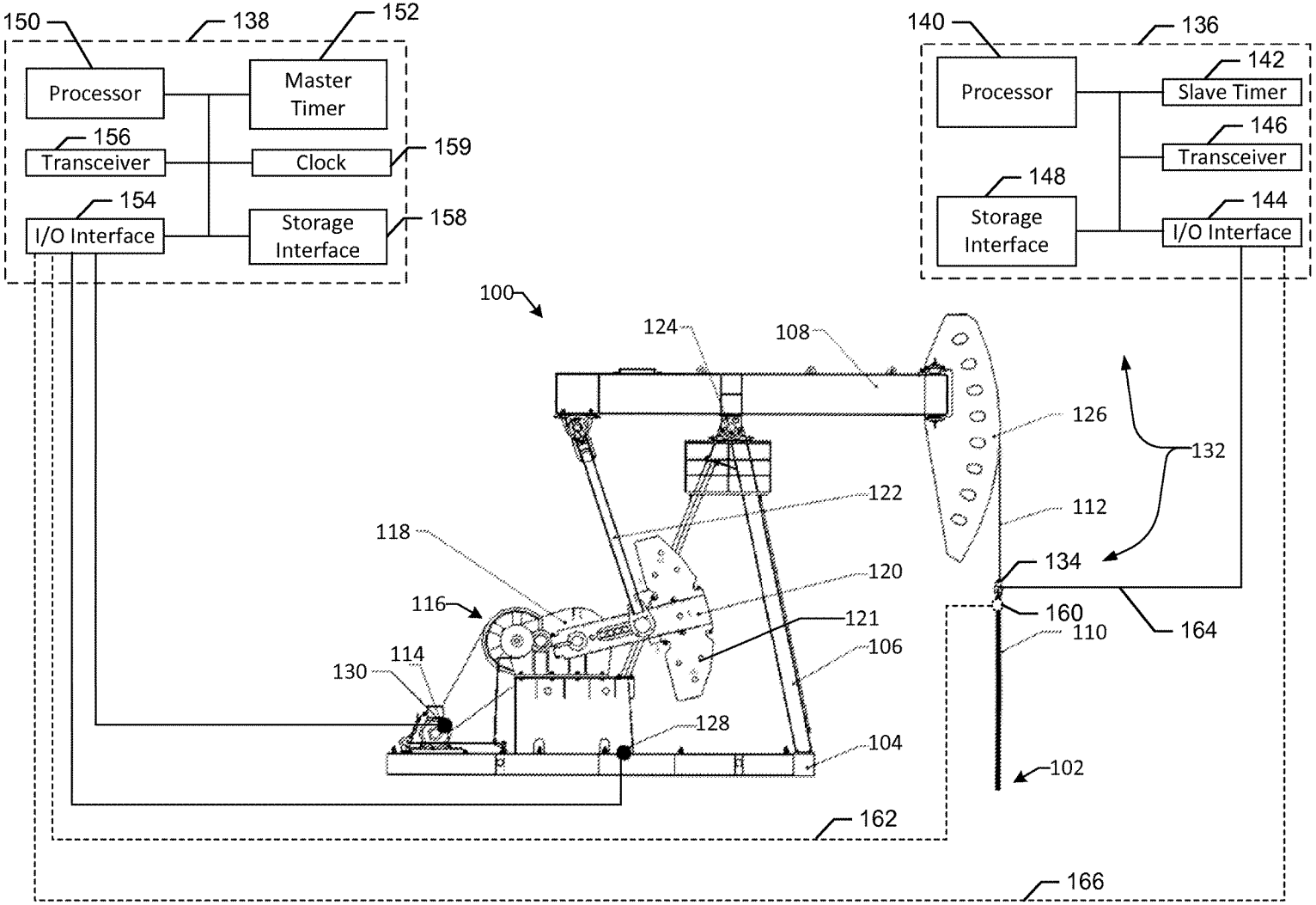
FIG. 1 shows a pumping unit including an example apparatus in accordance with the teachings of this disclosure.

Pumping units or reciprocating rod pump systems often employ diagnostic devices or dynamometer cards to determine or analyze operational characteristics. A pump dynamometer card provides position versus time data, load versus time data, and load versus position data determined by collecting data associated with the pumping unit during operation and/or employing a mathematical model or wave equation. For increased accuracy of pump dynamometer cards, polished rod load values and polished rod position values are measured at relatively high frequency (e.g., greater than 20 Hz). Additionally, to ensure accuracy of the generated dynamometer cards, a particular measured load (e.g., a force) imparted to a polished rod should correlate or be paired (e.g., synchronized) with a measured stroke position of the polished rod. Failing to correlate or pair a measured load with a stroke position of the polished rod at which the load was measured may lead to inaccurate data and, thus, inaccurate dynamometer cards. Thus, synchronizing the load and position values of the polished rod significantly increases accuracy of a pump dynamometer card.

Some pumping units employ a load cell mounted to a polished rod to measure a load of the polished rod and a position sensor to determine a position of the polished rod. The load cell and/or position sensor are often coupled to a rod pump controller via a wired connection using a data transfer cable. As a result of the wired connection, the pump rod controller receives a measured load value substantially simultaneously with detection of a polished rod position corresponding to the measured load value. As a result, a first polished rod position value at a first sampling time and a first polished rod load value at the first sampling time are properly paired because there is effectively no time lag associated with the wired connection. Further, with a wired connection, the rod pump controller determines the sampling frequency of the load values and the position values using a single timer, thereby eliminating concerns of timer drift. However, the wired connection or cable often becomes damaged because the cable of the wired connection is subjected to repeated motion that may cause the cable to kink. As a result, polished rod load cells coupled to a rod pump controller via a wired connection often require increased maintenance.

To reduce maintenance associated with a wired connection between the load cell and the pump rod controller, some known pumping units employ a wireless communication link to transmit the load values measured by the load cell to the pump rod controller. However, wireless transmission of a load cell signal introduces time delays (e.g., wireless communication delay and timer drift). For example, a wireless communication often includes a wireless communication delay between a time when a signal is transmitted by the wireless communication link and a time when the signal is received by the rod pump controller. As a result, a first polished rod load value at a first sampling time is received by the rod pump controller at a time that is offset relative to a time that the polished rod position value is measured or determined. Additionally, in some examples, a sampling frequency to obtain polished rod position values is controlled by a first timer and a sampling frequency to obtain polished rod load values is controlled by a second timer. While the first and second timers may initially be synchronized, drift of the first timer is often different than drift of the second timer causing the sampling frequency of the first timer to be different than the sampling frequency of the second timer. The drift may cause the samples obtained to be more offset (e.g., variable offset compared to a constant offset) than they would otherwise be due to the wireless communication delay between the wireless communication link and the rod pump controller. Thus, drift of the timers may cause a variable offset that may be difficult to determine when pairing polished rod position values with the polished rod load values.

As a result, a load cell signal provided by the load cell when the polished rod is at a particular stroke position may not correspond to the polished rod stroke position determined by the rod pump controller. In other words, the rod pump controller may receive or determine the polished rod position value at a first time and the rod pump controller may receive the measured load value via the wireless communication link corresponding to the polished rod position at a second time different than the first time. As a result, the measured load values are not synchronized or paired with the proper polished rod position values. As noted above, failure to properly pair measured load values with the corresponding polished rod position value causes inaccuracies when generating a pump dynamometer card. To reduce delay between the load cell signals and the position signals corresponding to the load signals, some example apparatus digitize an analog load cell signal (e.g., a millivolt level signal), and transmit the digital signal to a receiver of the pump rod controller. The receiving may convert the digital signal back to an analog signal. However, such approach may lead to inaccuracies due to, for example, gain (e.g., power gain).

The methods and apparatus disclosed herein identify or determine positions of a polished rod throughout a stroke of a pumping unit and correlate and/or determine corresponding loads imparted to the polished rod at the polished rod positions. In other words, the example methods and apparatus disclosed herein synchronize and/or pair determined polished rod position values with the proper corresponding or respective ones of the measured load values imparted to the polished rod at the polished rod positions. Specifically, the example methods and apparatus disclosed herein account for time delays between a wirelessly transmitted load signal (e.g., representative of a force imparted to a polished rod) and a corresponding position signal (e.g., representative of the position of the polished rod when the load on the polished rod is measured). Thus, the example methods and apparatus disclosed herein synchronize and/or pair load values of a polished rod and position values of the polished rod. Without compensating for a transmission delay as disclosed herein for a given position of a polished rod, a measured position value of the polished rod may not be accurately associated with the measured load.

To synchronize and/or pair load values and position values, the example methods and apparatus disclosed herein obtain position values and load values of a polished rod at a similar sampling frequency (e.g., 20 Hz). For example, a position sensor performs position measurements of the polished rod at a sampling frequency that is similar to a sampling frequency at which a load sensor or cell obtains the load values of the polished rod. To provide similar sampling frequency, the example methods and apparatus disclosed herein employ a first timer associated with the position sensor and a second timer associated with the load sensor. To significantly reduce timer drift associated with the timers, the example methods and apparatus disclosed herein periodically (e.g., approximately every 100 milliseconds) synchronize the timers. Additionally, the example methods and apparatus disclosed herein estimate an average time delay induced by a wireless communication link (e.g., a radio transmission system).

During operation, an example rod pump controller determines and/or receives position versus time measurements of the polished rod and load versus time measurements. The rod pump controller biases or modifies the load versus time measurements by the estimated average time delay induced by the wireless communication link. When the adjusted time values of the received load values do not correspond to the time values of the received position values, the example methods and apparatus disclosed herein determine the load values associated with the position versus time values. Alternatively, the example methods and apparatus disclosed herein determine the position values associated with the load versus the biased time values.

By accounting for wireless transmission delay and timer drift, the example methods and apparatus disclosed herein mathematically determine or pair the load measurements and the position measurements based on the received load values versus adjust time and the position values versus time. Some example methods and apparatus disclosed herein employ interpolation to associate a measured load on the polished rod with a position of the polished rod. For example, an example rod pump controller disclosed herein mathematically determines load values corresponding to respective position values of a polished rod that are determined or received by a controller of a pumping unit. In some examples, an example rod pump controller disclosed herein mathematically determines position values corresponding to respective load values of a polished rod that are received by the rod pump controller.

FIG. 1 shows a pumping unit 100 that can be used to produce oil from an oil well 102. The pumping unit 100 includes a base 104, a Sampson post 106 and a walking beam 108. The walking beam 108 may be used to reciprocate a polished rod 110 relative to the oil well 102 via a bridle 112. The pumping unit 100 includes an engine or motor 114 that drives a belt and sheave system 116 to rotate a gear box 118 and, in turn, rotate a crank arm 120 and a counterweight 121. A pitman 122 is coupled between the crank arm 120 and the walking beam 108 such that rotation of the crank arm 120 moves the pitman 122 and the walking beam 108. As the walking beam 108 pivots about a pivot point and/or saddle bearing 124, the walking beam 108 moves a horse head 126 and the polished rod 110.

To detect when the crank arm 120 completes a cycle and/or passes a particular angular position, a first sensor 128 is coupled adjacent to the crank arm 120. To detect and/or monitor a number of revolutions of the motor 114, a second sensor 130 is coupled adjacent the motor 114. Data obtained from the first sensor 128 and/or the second sensor 130 may be used to determine (e.g., measure or infer) a position of the polished rod 110 throughout a stroke of the pumping unit 100.

To measure or detect a load (e.g., force) imparted to the polished rod 110 during operation, the example pumping unit 100 employs a load measurement assembly 132. The load measurement assembly 132 includes a load sensor 134 (e.g., a load cell) and a wireless communication apparatus 136 (e.g., coupled via a cable 164). The load cell 134 is positioned or coupled to the polished rod 110 and the wireless communication apparatus 136 communicates the loads measured by the load sensor 134 to a rod pump controller 138. In the illustrated example, communications between the rod pump controller 138 and the wireless communication apparatus 136 may be accomplished via, for example, a radio frequency. For example, transceivers 156 and 146 of the respective rod pump controller 138 and the wireless communication apparatus 136 enable communication between the rod pump controller 138 and the wireless communication apparatus 136. For example, communication between the wireless communication apparatus 136 and the rod pump controller 138 may be established via a 2-way, high bandwidth (e.g., 57,600 BAUD or higher) wireless network or communication link. In some examples, communication between the wireless communication apparatus 136 and the rod pump controller 138 may be established via a one-way, high bandwidth wireless network or communication link when, for example, the wireless communication apparatus 136 includes a master timer 152 and the rod pump controller 138 includes a slave timer 142.

The wireless communication apparatus 136 of the illustrated example includes a processor 140, the slave timer 142, an input/output interface 144, the transceiver 146, and a storage interface or memory 148. Data obtained from the load sensor 134 (e.g., a load cell) is received by the input/out (I/O) device 144 and may be stored in the memory 148, which is accessible by the processor 140. For example, during operation, the processor 140 receives load values from the load sensor 134 during a sampling period (e.g., every 50 milliseconds, every second, etc.). In some examples, the processor 140 and/or the load sensor 134 employ the slave timer 142 to determine the sampling period and/or to determine when to request, send and/or receive data (e.g., measured load values) from the load sensor 134. In some examples, the processor 140 also employs the slave timer 142 to determine when to send data (e.g., measured load values) to the rod pump controller 138.

The rod pump controller 138 of the illustrated example includes a processor 150, the master timer 152, an input/output interface 154, the transceiver 156 and a storage interface or memory 158, and a clock 159. Data obtained from the first and second sensors 128 and 130 are received by the input/out (I/O) device 154 of the rod pump controller 138 and stored in the memory 158 that is accessible by the processor 150. For example, during operation, the processor 150 receives and/or substantially simultaneously receives during a sampling period (e.g., every 50 milliseconds, every second, etc.) a crank pulse count and/or pulse from the first sensor 128, a motor pulse count versus time and/or a pulse from the second sensor 130. In some examples, the processor 150 and/or the first and second sensors 128 and 130 employ the master timer 152 to determine a sampling period and/or to determine when to request, send and/or receive data (e.g., measured parameter values) from the first and second sensors 128 and 130.

In operation, the rod pump controller 138 measures or infers positions of the polished rod 110 as the pumping unit 100 moves through a stroke cycle based on the signal values provided by the first sensor 128 and/or the second sensor 130. The rod pump controller 138 receives load values of the polished rod 110 as the polished rod 110 moves through the stroke cycle. However, a time delay between transmitting the load value from the wireless communication apparatus 136 and receiving the transmitted load value by the rod pump controller 138 may cause a time stamp of a corresponding position value to differ from a time stamp of the received load value, resulting in inaccurate pairing of the position value and the load value.

Figure 2:
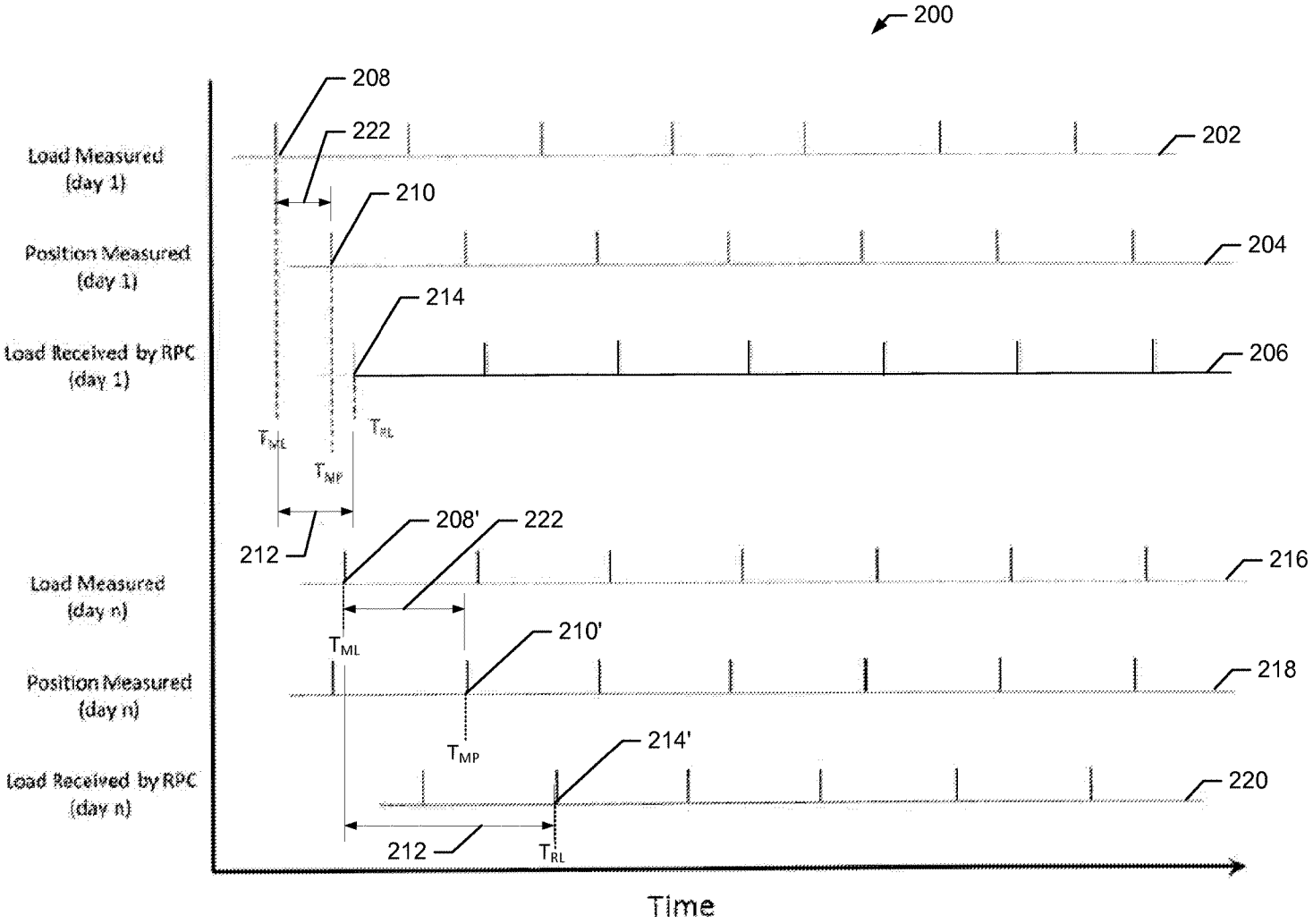
FIG. 2 depicts an example timing sequence for sampling and receiving load values and position values of a polished rod of a known pumping unit.

For example, FIG. 2 depicts a timing sequence 200 for sampling and receiving load values and position values at the rod pump controller 138. The first set of traces 202, 204 and 206 may be obtained on a particular day or particular time. In the sequence represented by the traces 202, 204 and 206, a load 208 is measured by the wireless communication apparatus 136 at time $T_{ML}$. As noted above, the wireless communication apparatus 136 is programmed to read and transmit samples at a certain frequency such as, for example, every 50 milliseconds. The rod pump controller 138 measures a position 210 of the polished rod 110 at time $T_{MP}$. After a certain amount of time (e.g., a wireless communication or transmission delay 212), the rod pump controller 138 receives the measured load 214 from the wireless communication apparatus 136 at time $T_{RL}$.

A second set of traces 216, 218 and 220 is representative of a different day and/or time relative to the first set of traces 202, 204 and 206. In the sequence represented by the traces 216-220, a load 208' is measured by the wireless communication apparatus 136, a position 210' of the polished rod 110 is measured by the rod pump controller 138, and the measured load 214' is received by the rod pump controller 138. In the illustrated example, the frequency of sampling for the position and load are the same or substantially similar (e.g., every 50 milliseconds). As shown by a comparison of the traces 202-206 and 216-220, drift and/or error 222 in the timers 142 and 152 of the respective wireless communication apparatus 136 and the rod pump controller 138 may cause the time of measured position $T_{MP}$ and the time of measured load $T_{ML}$ (e.g., a sample frequency) to fluctuate or drift significantly over time. Thus, even though the wireless communication delay 212 may be constant, the timer drift 222 is a variable value that affects the wireless communication delay 212. For example, although timer drift may be constant over a few consecutive strokes of the pumping unit 100, timer drift 222 between the master timer 152 and the slave timer 142 may drift significantly over time (e.g., after four or six consecutive strokes of the pumping unit 100), thereby causing inaccuracies in the sampling period or frequency. For example, timer drift 222 for known crystal oscillators might result in clock drift of 10 parts per million (ppm) or more. Such timer drift may occur in the master timer 152, the slave timer 142 and/or both the master timer 152 and the slave timer 142. For example, a 10 ppm error of magnitude could result in timer drift of 0.85 seconds/day. In some such examples, a sampling period of 50 milliseconds may result in timer drift of 1 millisecond every 100 seconds.

The example rod pump controller 138 of FIG. 1 is configured to account for time delays such those shown, for example, in FIG. 2. To account for the above-noted wireless communication delay 212 and timer drift 222 shown in FIG. 2, the example rod pump controller 138 is configured to account for an offset of time between the load value received by the rod pump controller 138 and the time the position is measured by the rod pump controller 138. An example offset determination may be described using equation (1) below.

$$(T_{RL}-T_{MP})=(T_{RL}-T_{ML})-(T_{MP}-T_{ML}); \quad \text{Equation (1)}$$

where, $T_{RL}$=time at which the load measurement is received by the rod pump controller 138; $T_{MP}$=time when the position is measured by the rod pump controller 138; and $T_{ML}$=the time when the load value was measured by the wireless communication apparatus 136. The value ($T_{RL}-T_{ML}$) is representative of wireless communication or transmission delay. The wireless communication delay, for example, may be a certain amount of delay caused by transmission and broadcasting time between the rod pump controller 138 and the wireless communication apparatus 136. The value ($T_{MP}-T_{ML}$) is representative of a timer drift value (e.g., a value between approximately zero and a sample frequency (e.g., 50 millisecond)) between the master timer 152 and the slave timer 142.

To synchronize and/or pair respective ones of the position values and respective ones of the load values, the wireless communication delay ($T_{RL}-T_{ML}$) is determined as a constant value (e.g., via a calibration process) and the timer drift delays ($T_{MP}-T_{ML}$) is corrected via a periodic synchronization (e.g., every 100 seconds) between the master timer 152 and the slave timer 142.

The wireless communication delay ($T_{RL}-T_{ML}$) may be obtained via experimental data, calibration and/or other methods. Referring to FIG. 1, in some examples, the wireless communication delay may be determined via a calibration process. In some examples, the wireless communication apparatus 136 of FIG. 1 may be calibrated with reference to a secondary load sensor 160 (e.g., a load cell device) that is wired via a cable 162 to the rod pump controller 138 temporarily (e.g., prior to normal operation of the pumping unit 100). For example, the rod pump controller 138 receives and/or reads the polished rod load values from the secondary load sensor 160 via the wired connection provided by the cable 162 and receives and/or reads the polished rod load values from the load sensor 134 provided by the wireless communication apparatus 136 over a period of time (e.g., one or two complete stroke cycles of the pumping unit 100). The load data provided by the load sensor 134 is analyzed or compared to the load data provided by the secondary load sensor 160 (e.g., either by the processor 150 of the rod pump controller 138 or a remote computer of a control room communicatively coupled to the rod pump controller 138) to determine a phase shift between the readings of the load sensor 134 and the corresponding load readings provided by the secondary load sensor 160. Upon completion of the calibration process, the secondary load sensor 160 and the cable 162 are removed from the pumping unit 100 and/or the polished rod 110 and normal operation and/or continuous operation of the pumping unit 100 can begin.

In some examples, the wireless communication apparatus 136 of FIG. 1 may be calibrated without use of the secondary load sensor 160 (e.g., a load cell device). In some such examples, the wireless communication apparatus 136 is communicatively coupled to the load sensor 134 via the wire or cable 164 and the I/O interface 144, and the wireless communication apparatus 136 is communicatively coupled to the rod pump controller 138 via a temporary cable or wire 166 (e.g., temporary meaning prior to normal operation of the pumping unit 100) and the I/O interface 154. In some such examples, the wireless communication apparatus 136 may be configured to emit a signal received from the load sensor 134 via an output of the I/O interface 144 and the transceiver 146. To complete the calibration process, the wireless communication device 136 communicates the signal provided by the load sensor 134 to the rod pump controller 138 wirelessly via the transceiver 146 and a wired output via the wired connection provided by the temporary cable 166. For example, the rod pump controller 138 receives and/or reads the same polished rod load value from the load sensor 134 provided via the wired connection provided by the cable 166 and the transceiver 146. A time difference between the load data provided by the load sensor 134 via the wired connection provided by the cable 166 and the wireless signal provided by the transceiver 146 is analyzed or compared to determine a wireless delay of the wireless communication provided between the wireless communication apparatus 136 and the rod pump controller 138. Upon completion of the calibration process, the cable 166 is removed from the pumping unit 100 and normal operation and/or continuous operation of the pumping unit 100 can begin.

In some examples, the wireless communication apparatus 136 of FIG. 1 may be calibrated without use of the load cell 134 and/or the secondary load sensor 160 (e.g., a load cell device). Thus, in some such examples, the temporary cable 162 is not required when the secondary load sensor 160 is not utilized. During a calibration process, the wireless communication apparatus 136 may be placed in calibration mode via, for example, a button on the wireless communication apparatus 136 and/or a calibration signal provided by the rod pump controller 138. The wireless communication apparatus 136 may be configured to emit a (e.g., standard) signal wirelessly via the transceiver 146 and via the wired connection provided by the temporary wire or cable 166 (i.e., without using the temporary wire or cable 162). For example, the wireless communication apparatus 136 may emit a waveform signal (e.g., a standard waveform, a 30 Hz to 60 Hz sine wave signal, a sawtooth wave signal, a square wave signal, etc.). Such signal may be emitted or sent simultaneously to the rod pump controller 138 wirelessly via the transceiver 146 and via the wired connection provided by the temporary cable 166 coupling the I/O interface 144 of the wireless communication apparatus 136 and the I/O interface 154 of the rod pump controller 138. To determine the wireless transmission delay, the rod pump controller 138 can analyze, for example, a phase shift (e.g., in seconds) or a difference between a time at which the signal is received via the transceiver 156 and a time at which the signal is received via the wired connection provided by the temporary cable 166. Upon completion of the calibration process, the cable 166 is removed from the pumping unit 100 and normal operation and/or continuous operation of the pumping unit 100 can begin.

Example methods of calibrating the rod pump controller 138 and the wireless communication apparatus 136 are described in connection with the flowcharts illustrated in FIGS. 6 and 7. The calibration methods 600 of FIG. 6 and/or 700 of FIG. 7 may yield consistent wireless communication delay values for the same manufacturer/model of a wireless communication apparatus (e.g., the wireless communication apparatus 136) when used with a particular rod pump controller (e.g., the rod pump controller 138). Thus, the calibration may only need to be performed once and the wireless communication delay may be a standard value applicable to the same manufacturer/model of wireless communication apparatus and rod pump controllers. Additionally, other pumping units that employ rod pump controllers and wireless communication apparatus similar to the rod pump controllers 138 and the wireless communication apparatus 136 may experience the same wireless communication delay and, thus, the wireless communication delay may be obtained using prior calibrated data from similar pumping units.

The timer drift ($T_{RL}-T_{MP}$) between the load measurement provided by the load sensor 134 and the position measurement provided by the rod pump controller 138 is accounted for during normal operation of the pumping unit 100. In operation, the processor 150 and/or the master timer 152 periodically generates a synchronization signal and communicates the synchronization signal to the wireless communication apparatus 136 via the transceiver 156. For example, the processor 150 may provide or broadcast a synchronization signal to the wireless communication apparatus 136 every 100 seconds. The synchronization signal causes the slave timer 142 to reset. An example method of synchronizing the master timer 152 and the slave timer 142 is illustrated in the example flowchart shown in FIG. 5. In the illustrated example, the rod pump controller 138 includes the master timer 152 and the wireless communication apparatus 136 includes the slave timer 142. However, in some examples, the rod pump controller 138 includes the slave timer 142 and the wireless communication apparatus 136 includes the master timer 152. For example, implementing the wireless communication apparatus 136 with the master timer 152 requires one-way communication between the wireless communication apparatus 136 and the rod pump controller 138 instead of two-way communication as shown in FIG. 1.

With the wireless communication delay determined and the timer drift significantly reduced or eliminated, the example methods and apparatus disclosed herein account for time delays between the time when the measured load values are transmitted by the wireless communication apparatus 136 and the time when the rod pump controller 138 receives the transmitted measured load values, where such time delay would otherwise cause improper pairing of the load values and the respective measured position values. As noted above, such improper pairing may cause inaccurate pump dynamometer cards. In particular, the rod pump controller 138 of the illustrated example correlates, synchronizes and/or pairs mathematically determined load values of the polished rod 110 with respective ones of measured or inferred position values of the polished rod 110. Specifically, the example rod pump controller 138 uses the measured load values (e.g., first load values) provided by the wireless communication apparatus 136 and (e.g., mathematically) determines load values (e.g., second load values) associated with the determined polished rod positions when time stamps of the received measured load values from the wireless communication apparatus 136 do not correspond or correlate with time stamps of the determined position values. For example, in operation, the rod pump controller 138 determines (e.g., measures or infers) a position of the polished rod 110 based on a signal provided by the sensor 128 and/or 130 and associates a determined load value of the polished rod 110 corresponding to the position value of the polished rod 110 when the received load value does not correspond with the measured position value.

For example, FIG. 3A illustrates an example reference table 300 having position data provided by the rod pump controller 138 using a sampling period of 50 milliseconds (e.g., 20 Hz frequency) and the time at which the rod pump controller 138 receives the polished rod load measurements (e.g., first set of load values) transmitted by the wireless communication apparatus 136 without considering the offset delay provided by, for example, Equation (1). Similar to the rod pump controller 138, the wireless communication apparatus 136 measures and transmits the polished rod load values using a sampling period of 50 milliseconds (e.g., 20 Hz frequency). In the illustrated example of FIG. 3A, the polished rod load signals provided by the wireless communication apparatus 136 are read/received by the rod pump controller 138 approximately five milliseconds after the polished rod position values are measured or inferred by the rod pump controller 138.

Referring to FIG. 3A, the reference table 300 includes a first or left column 302 (in the orientation of FIG. 3A) corresponding to the time in seconds of the measured or inferred polished rod position values and the polished rod load values received by the rod pump controller 138, the second or middle column 304 corresponds the polished rod position values received from and/or determined by the first and second sensors 128 and 130, and the third or the right column 306 corresponds to the polished rod load values received from and/or determined by the load sensor 134.

Although each of the polished rod load values is read or received by the rod pump controller 138 approximately 5 milliseconds after receiving the corresponding position measurement value, the time delay between the actual polished rod load measured by the wireless communication apparatus 136 and the polish rod load value received by the rod pump controller 138 may be larger or smaller than the five milliseconds as illustrated in the reference table 300. If the load measurement (e.g., the load of 10234 lbs.) of the polished rod 110 is assigned to the nearest "in time" position value (e.g., 0.05 millisecond) of the polished rod 110 to define a pair of measured points, significant error may be introduced when determining, for example, the pump dynamometer card.

To determine or accurately pair the measured or inferred polished rod position values and the polished rod load values without significant error, the example rod pump controller 138 of the illustrated example biases each time stamp of the received polished rod load values by an offset value (e.g., a wireless communication delay determined by Equation (1)). For example, FIG. 3B is a reference table 308 similar to the reference table 300 of FIG. 3A, but having the time stamps of each of the received polished rod load values modified by the offset value and/or wireless communication delay value (e.g., determined via Equation (1)). For example, the reference table 308 of FIG. 3B includes a fourth column 310 illustrating the polished rod load values provided by wireless communication apparatus 136 based on the adjusted time stamps determined by the offset or wireless communication delay. For example, each time stamp of the received polished rod load values is modified or adjusted by the offset value (e.g., third time values). To reflect the received time stamp based on the offset, a first column 312 of the example reference table 308 of FIG. 3B includes time stamp entries adjusted by the wireless communication delay value. For example, if the transmission delay between the rod pump controller 138 and the wireless communication apparatus 136 (e.g., the wireless communication delay) is 20 milliseconds, the entries of the first column 312 of the reference table 308 reflect the time stamps that the polished rod load values are received and adjusted by the wireless communication delay value (e.g., third time stamp values). For example, in the reference table 300 of FIG. 3A, the polished rod load value received at 0.55 seconds is approximately 10,234 pounds. However, a wireless communication delay value of 20 milliseconds determined by, for example, Equation (1) indicates that the time at which the polished rod load value received at 0.55 seconds was taken or measured by the load sensor 134 of the wireless communication apparatus 136 at a time stamp of 0.035 seconds (e.g., 0.055 seconds–0.020 seconds). Thus, the first column 312 of the example reference table 308 is adjusted to include the additional time stamp entries (when compared to the reference table 300 of FIG. 3A) and the fourth column 310 includes the polished rod load values associated with the biased or adjusted time stamp. As shown in the reference table 308 of FIG. 3B, however, the biased load measurements in the fourth column 310 to do not align, correlate, synchronize, pair up and/or match up with the times at which the polished rod positions were measured or inferred by the rod pump controller 138.

FIG. 3C illustrates a reference table 314 that can be generated in connection with and/or used to implement the examples disclosed herein. Using the biased load data of FIG. 3B, the processor 150 of the rod pump controller 138 determines polished rod load values (e.g., a second set of load values) associated with the polished rod position values and/or the time values of the polished rod position values. For example, the processor 150 and/or more generally the rod pump controller 138 determines polished rod load values that correspond to the polished rod position values received by the rod pump controller 138 via, for example, interpolation. Referring to FIG. 3C, the example reference table 314 includes determined polished rod load values (e.g., second load values determined via interpolation) that correspond to the measured or inferred position values obtained at a particular time or time stamp. The example table 314 of FIG. 3C is similar to the table 308 shown in FIG. 3B, but includes a fifth column 316 to illustrate the determined polished rod load values. Specifically, the processor 150 and/or more generally the rod pump controller 138 employs the time stamp values, the polished rod position values and the polished rod load values, for example, shown in reference table 308 of FIG. 3B to interpolate the polished load values. Thus, the example rod pump controller 138 pairs a position value (e.g., 14.75 inches) received by the rod pump controller 138 at a particular time (e.g., 0.05 seconds) with an interpolated load value (e.g., 10301 lbs.) associated with the particular time (e.g., 0.05 seconds).

In the illustrated example, the processor 150 of the rod pump controller 138 employs a linear interpolation algorithm to determine the interpolated load shown in the fifth column 316. In the illustrated example, the interpolated load value (e.g., 10816 lbs) is determined based on a first load value (e.g., 10456 lbs) at adjusted to time 0.085 seconds (i.e., received at time 0.105 and adjusted based the wireless communication delay time of 20 milliseconds) and a second load value (e.g., 11657 lbs) adjusted to time 0.135 seconds (i.e., received at time 0.155 that has been adjusted by the wireless communication delay time of 20 milliseconds). For example, a linear interpolation may be determined by the following equation:

$$y = y_0 + (y_1 - y_0)\left[\frac{x - x_0}{x_1 - x_0}\right]; \qquad \text{Equation (2)}$$

where y is the determined polished rod load value, $y_0$ is a first received measured load value, y1 is a second received measured load value, x is the time value associated with the load value to be determined, $x_0$ is the time value at which the first measured load value was received by the rod pump controller 138, and $x_1$ is the time value at which the second measured load value was received by the rod pump controller 138. For example, to determine the a load value associated with time value 0.1 seconds and position value 15.78 inches as shown in the reference table 314, the processor 150 may employ Equation 2 to determine a load value (y) of 10816 lbs associated or correlating with the time value 0.1 seconds and the position value 15.78 using the measured load value 10456 lbs as $y_0$, the measured load value 11657 lbs as $y_1$, 0.1 seconds as x, 0.085 seconds as $x_0$ and 0.135 seconds as $x_1$. In some examples, any other information illustrated in reference table 314 and/or other collected data may be employed to determine the load values associated with respective ones of the position values. In some examples, other interpolation methods may be employed including, but not limited to, quadratic interpolation, polynomial interpolation, Lagrange interpolation, spline interpolation, etc.

While an example manner of implementing the wireless communication apparatus 136 and/or the rod pump controller 138 are illustrated in FIG. 1, one or more of the elements, processes and/or devices illustrated in FIG. 1 may be combined, divided, re-arranged, omitted, eliminated and/or implemented in any other way. Further, the processor 140, the slave timer 142, the I/O interface 144, the transceiver 146, the memory 148, and/or, more generally, the example wireless communication apparatus 136 of FIG. 1 may be implemented by hardware, software, firmware and/or any combination of hardware, software and/or firmware. Additionally, the processor 150, the master timer 152, the I/O interface 154, the transceiver 156, the memory 158, the clock 159 and/or, more generally, the example rod pump controller 138 of FIG. 1 may be implemented by hardware, software, firmware and/or any combination of hardware, software and/or firmware. Thus, for example, any of the processor 140, the slave timer 142, the I/O interface 144, the transceiver 146, the memory 148, and/or, more generally, the example wireless communication apparatus 136 and/or any of the processor 150, the master timer 152, the I/O interface 154, the transceiver 156, the memory 158, the clock 159 and/or, more generally, the example rod pump controller 138 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example any of the processor 140, the slave timer 142, the I/O interface 144, the transceiver 146, the memory 148, and/or, more generally, the example wireless communication apparatus 136 and/or any of the processor 150, the master timer 152, the I/O interface 154, the transceiver 156, the memory 158, the clock 159 and/or, more generally, the example rod pump controller 138 is/are hereby expressly defined to include a tangible computer readable storage device or storage disk such as a memory, a digital versatile disk (DVD), a compact disk (CD), a Blu-ray disk, etc. storing the software and/or firmware. Further still, the example wireless communication apparatus 136 and/or the rod pump controller 138 of FIG. 1 may include one or more elements, processes and/or devices in addition to, or instead of, those illustrated in FIG. 1, and/or may include more than one of any or all of the illustrated elements, processes and devices. While FIG. 1 depicts a conventional crank-balanced pumping unit, the examples disclosed herein can be implemented in connection with any other pumping unit.

Flowcharts representative of example methods for implementing the wireless communication apparatus 136 and/or the rod pump controller 138 of FIG. 1 are shown in FIGS. 4-7. In this example, the methods of FIGS. 4-7 may be implemented by machine readable instructions that comprise a program for execution by a processor such as the processor 812 shown in the example processor platform 800 discussed below in connection with FIG. 8. The program may be embodied in software stored on a tangible computer readable storage medium such as a CD-ROM, a floppy disk, a hard drive, a digital versatile disk (DVD), a Blu-ray disk, or a memory associated with the processor 812, but the entire program and/or parts thereof could alternatively be executed by a device other than the processor 812 and/or embodied in firmware or dedicated hardware. Further, although the example program is described with reference to the flowcharts illustrated in FIGS. 4-7 many other methods of implementing the example wireless communication apparatus 136 and/or the example rod pump controller 138 may alternatively be used. For example, the order of execution of the blocks may be changed, and/or some of the blocks described may be changed, eliminated, or combined.

As mentioned above, the example methods of FIGS. 4-7 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example methods of FIGS. 4-7 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Figure 4:
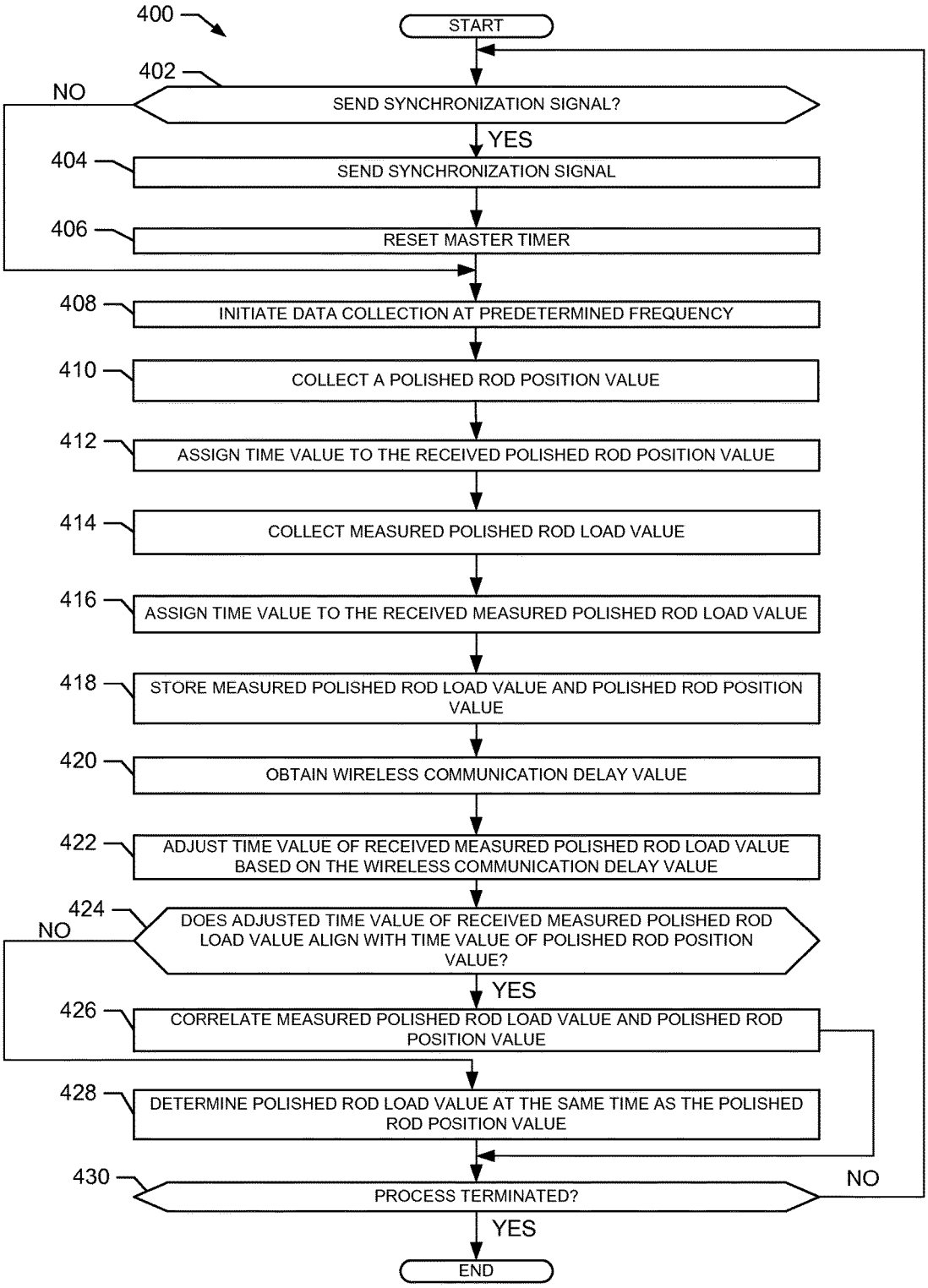
FIGS. 4-7 are flowcharts representative of example methods that may be used to implement the example apparatus of FIG. 1.

FIG. 4 illustrates an example method 400 of implementing the example rod pump controller 138 of FIG. 1. The pump rod controller 138 performs the method 400 of FIG. 4 to determine or pair a polished rod load value with a polished rod position value at a given instance of time. At block 402, the processor 150 determines if a synchronization signal should be sent to the wireless communication apparatus 136 (block 402). The synchronization signal initiates a reset of the master timer 152 and the slave timer 142 to reduce and/or eliminate timer drift (e.g., timer drift 222 of FIG. 2) between the master timer 152 and the slave timer 142. For example, the processor 150 of the illustrated example determines if a synchronization signal should be sent at block 402 by determining if a predetermined synchronization time period has lapsed (e.g., using the clock 159 of the primary controller 138). For example, the synchronization signal may be sent periodically (e.g., every 100 seconds). If the processor 150 determines that the synchronization signal should be sent, the processor 150 broadcasts or transmits the signal to the wireless communication apparatus 136 via the transceiver 156 (block 404). Once the synchronization signal is sent at block 404, the processor 150 resets the master timer 152 (block 406). In some examples, to help with the synchronization process, the processor 150 does not reset the master timer 152 until after a time period equivalent to the wireless communication delay from the time when the synchronization signal was sent.

After the master timer 152 is reset at block 406 or if a synchronization signal is not sent at block 402, the processor 150 of the rod pump controller 138 initiates data collection based on a predetermined frequency (block 408). For example, the processor 150 retrieves from the memory 158 a predetermined sampling frequency or sampling period (e.g., 20 Hz or 50 milliseconds) for obtaining data from the first and second sensors 128 and 130 to measure or infer the polished rod position values or for obtaining the polished rod load values from the wireless communication apparatus 136. The predetermined frequency or sampling period may be provided or modified via a user input interface of the rod pump controller 138. In some examples, the processor 150 initiates and/or initializes the master timer 152 and determines, via the master timer 152, the amount of time elapsed since the master timer 152 was initialized. The processor 150 determines if the elapsed time is at or after the predetermined time such as, for example, fifty milliseconds (e.g., the sampling period).

If the processor 150 determines that the elapsed time is at or after the predetermined frequency value, based on data from the first sensor 128 and the second sensor 130, the processor 150 collects the polished rod position value (block 410). For example, the processor 150 measures or infers the polished rod position value based on the signals provided by the first sensor 128 and/or the second sensor 130. The processor 150 also assigns a time value (e.g., a time stamp) to the received polished rod position value (block 412). For example, the processor 150 may determine the time that the polished rod position value was received using, for example, the clock 159 of the rod pump controller 138.

The processor 150 collects a measured polished rod load value from the wireless communication apparatus 136 (block 414). Using the clock 159 of the rod pump controller 138, the processor 150 assigns a time value (e.g., a time stamp) to the received measured polished rod load value (block 416). The polished rod position value and its assigned time, and the measured polished rod load value and its assigned time are stored in the memory 158 (block 418). In some examples, the processor 150 generates a reference table similar to the reference table 300.

The processor 150 then obtains the wireless communication delay value from, for example, the memory 158 (block 420). The processor 150 adjusts the time value or time stamp assigned to the measured polished rod load value by a value equivalent to the wireless communication delay (block 422). For example, referring to the reference table 308 of FIG. 3B and/or the reference table 316 of FIG. 3C, each of the time stamps recorded when the rod pump controller 138 receives the measured polished rod load values are adjusted by the wireless communication delay value. In some examples, the assigned time stamp of a received measured polished rod load value is reduced by the wireless communication delay value.

The processor 150 determines if the adjusted time value of the received measured polished rod load value aligns with the time value of the polished rod position value (block 424). If the adjusted time value of the measured polished rod load value aligns or correlates with (e.g., is equal to) the time value of the position value at block 424, the processor 150 assigns or correlates the measured polished rod load value and the polished rod position value. (block 426).

If the adjusted time value of the measured polished rod load value does not correspond to (e.g., is not equal to) the time value of the polished rod position value at block 424 (e.g., see reference table 308), the processor 150 determines a polished rod load value associated with the time value of the polished rod position value (e.g., see FIG. 3C) (block 428). For example, to determine the second polished rod load value, the processor 150 mathematically determines (e.g., interpolates) the polished rod load value using the polished rod position value and its time stamp, the measured polished rod load value, and the adjusted time stamp value of the measured polished rod load values to obtain, synthesize or determine the polished rod load value for the same time value (e.g., time stamp) as the polished rod position value (e.g., obtained at blocks 410 and 412). The processor 150 correlates or pairs the polished rod position value with the determined polished rod load value at the time value of the polished rod position value. In some examples, the polished rod position value and the determined polished rod load value pair is used to generate a pump dynamometer card of the pumping unit 100.

To determine the polished rod load value via interpolation, the processor 150 determines that an interpolation should be performed when the rod pump controller 138 receives at least two measured polished rod load values. In some examples, the determination of whether to perform an interpolation can be based on a predetermined time period. For example, the predetermined time period may be set at 1 second, 10 seconds, and/or any other desired time interval or period. For example, after every predetermined time period, the processor 150 may perform an interpolation based on the polished rod position values and the measured polished rod load values collected, the time stamp values of the polished rod position values and the adjusted time stamp values of the measured polished rod load values. The processor 150 may employ the master timer 152, the clock 159 and/or other timer of the rod pump controller 138 to determine if the predetermined time period has expired. In some examples, an interpolation is performed once a certain number of polished rod position values (e.g., between two and four values) and a certain number of measured polished rod load values (e.g., between two and four values) are obtained or collected. For example, the processor 150 may determine the number of polished rod position values and the number of measured polished rod load values obtained by the rod pump controller 138. In some examples, the processor 150 performs an interpolation every time a polished rod position value and a measured polished rod load value is collected or received by the rod pump controller 138. In some such examples, a lack of sufficient data points (e.g., two measured polished rod load values) needed to perform the interpolation results in the processor 150 returning to block 402 for additional data collection.

After the measured polished rod load value is correlated with the polished rod position value at block 426 or the load value is determined at the same time as the polished rod position value at block 428, the processor 150 determines if the collection of polished rod position values and the measured polished rod load values should terminate (block 430). If the process is to continue at block 430, the process returns to block 402. If the processor 150 determines that the process is to terminate at block 430, then process 400 ends. The processor 150 determines if the process is to terminate at block 430 when the rod pump controller 138 no longer receives the polished rod position values and/or the measured polished rod load values. For example, the rod pump controller 138 ceases to receive polished rod position values and/or the measured polished rod load values when, for example, the motor 114 is turned off In some examples, the process terminates after expiration of a predetermined period of time such as, for example, 1 hour, 24 hours, 48 hours, and/or any other desired time.

Figure 5:
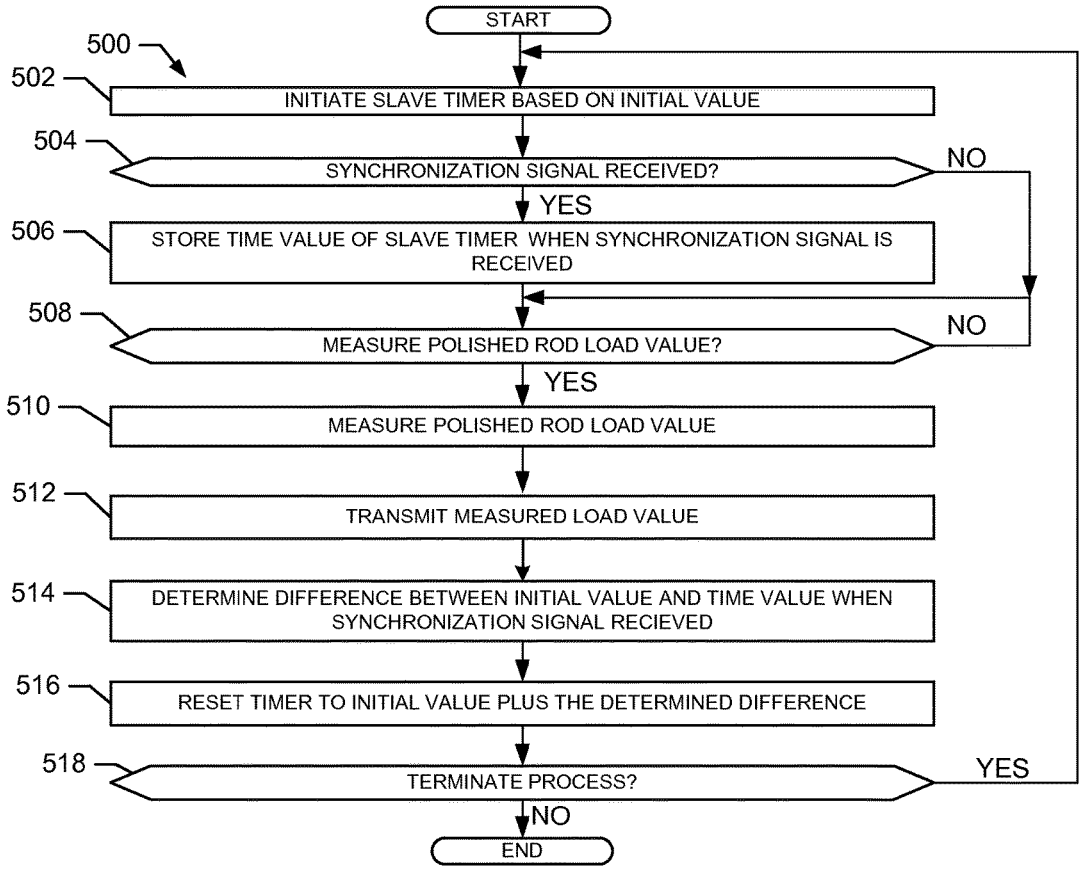

FIG. 5 illustrates an example method 500 for implementing the example wireless communication apparatus 136 in accordance with the teachings of this disclosure. Referring to FIG. 5, the processor 140 of the wireless communication apparatus 136 initiates the slave timer 142 (block 502). The slave timer 142, for example, counts down from an initial value representative of a sampling time (e.g., 50 milliseconds) to a zero value to indicate when a polished rod load value is to be measured. The slave timer 142 may be used to set a sampling period and/or to substantially ensure data is obtained from the load sensor 134 at a frequency that is equal to the frequency provided by the master timer 152 for collecting polished rod position values.

The processor 140 determines if a synchronization signal is received (block 504). For example, the processor 140 receives the synchronization signal initiated or sent by the rod pump controller 138 at block 404 of FIG. 4. In other examples, the synchronization signal may be initiated or sent from a remote device (e.g., a controller of a control room, a controller of a field device, etc.). If the processor 140 determines that the synchronization signal is received at block 504, the processor 140 determines and stores a time value or time stamp of the slave timer 142 when the synchronization signal is received (block 506). For example, the processor 140 stores the time stamp in the memory 148.

If the synchronization signal is not received at block 504 or the processor 140 stores the time value of the slave timer 142 when the synchronization signal is received at block 506, the processor 140 determines if a load on the polished rod 110 is to be measured (block 508). For example, the processor 140 of the example wireless communication apparatus 136 measures the polished rod load value upon the expiration of the slave timer 142. For example, if the frequency or sampling time of the slave timer 142 is set to measure the polished rod load values periodically (e.g., every 50 milliseconds), the processor 140 obtains the measured polished rod load value from the load sensor 134 (block 510). If the processor 140 determines that the sampling period has not yet expired at block 508, the processor 140 waits until the expiration of the sampling period to obtain the measured polished rod load value.

When the measured polished rod load value is measured by the load sensor 134, the processor 140 transmits a signal representative of the polished rod load value to the rod pump controller 138 via the transceiver 146 (block 512). The processor 140 determines a difference value between the initial time value of the slave timer 142 and the time stamp of the slave timer 142 when the synchronization signal was received (block 514). The processor 140 resets or adjusts the slave timer 142 to a value that is equal to the initial time value plus the determined difference value (block 516). For example, if the initial slave timer value or sampling time is set to 50 milliseconds, the slave timer 142 counts down from 50 milliseconds to zero, at which time the processor 140 measures the polished rod load value at block 508. However, if the processor 140 receives the synchronization signal from the rod pump controller 138 when the slave timer is at 48 milliseconds, the slave timer 142 is running 2 milliseconds faster than the master timer 152. However, the processor 140 of the illustrated example continues to allow the slave timer 142 to run to zero and measure the polished rod load value at block 510. The processor 140 then resets the slave timer 142 to a value of 52 milliseconds instead of 50 milliseconds (e.g., {(the initial reset value (50 milliseconds)+2}−time of the slave timer 142 at time that synchronization signal is received (48 milliseconds)).

Figure 6:
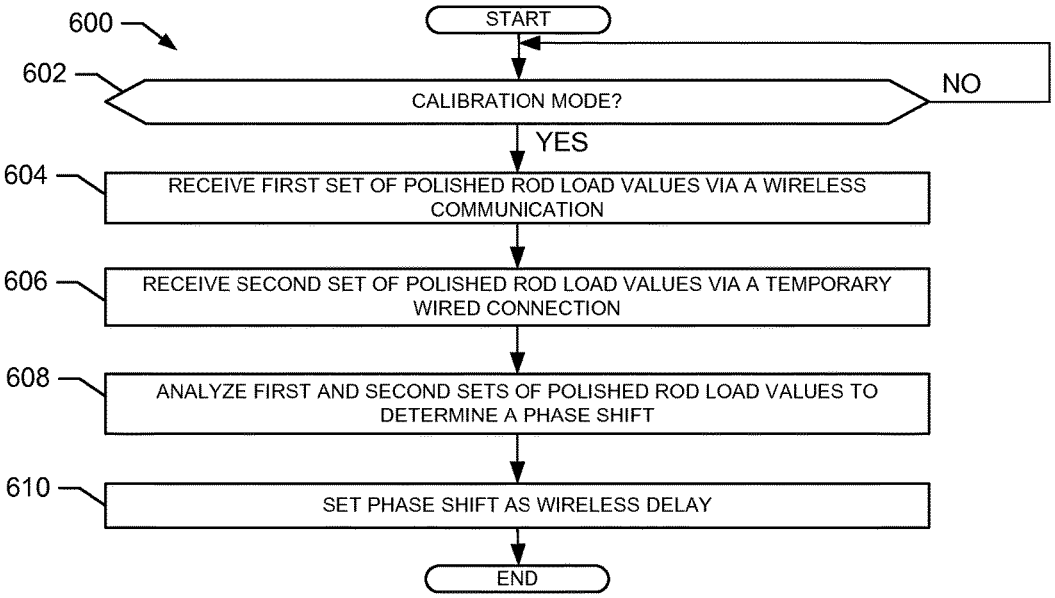

FIG. 6 illustrates an example method 600 of determining the wireless communication or transmission delay value in accordance with the teachings of this disclosure. The process 600 begins in a calibration preparation mode (block 602). The calibration mode may be initiated via a button on the rod pump controller 138 and/or the wireless communication device 136 and/or a calibration signal transmitted to the rod pump controller 138 and/or the wireless communication device 138. If the processor 150 determines that the rod pump controller 138 is not in calibration mode, the process returns to block 602. In the calibration mode 602, the example secondary load sensor 160 is coupled to the input/output interface 154 of the rod pump controller 138 via the wired cable 162 as shown, for example, in FIG. 1. Additionally, the load sensor 134 and the wireless communication apparatus 136 are communicatively coupled to the rod pump controller 138.

In the calibration mode, the processor 150 of the rod pump controller 138 receives a first set of polished rod load values via the load sensor 134 and the wireless communication apparatus 136 (block 604). The first set of polished rod load values may be determined at a sampling period of 50 milliseconds (e.g., a frequency of 20 Hz) across one stroke cycle of the pumping unit 100. The processor 150 employs the master timer 152 to determine the sampling period or frequency. Additionally, the processor 150 may employ the clock 159 to determine a time stamp at which each polished rod load value is received from the wireless communication apparatus 136. In some examples, the first set of polished rod load values are obtained across two or more stroke cycles of the pumping unit 100 and/or at any other desired sampling period (e.g., every 10 milliseconds, every second, etc.). In some examples, the first set of polished rod load values is stored in the memory 158.

In addition, the processor 150 of the rod pump controller 138 receives a second set of polished rod load values via the secondary load sensor 160 and the wired cable 162 (block 606). The second set of polished rod load values may be determined substantially simultaneously (e.g., at the same time) as the first set of polished rod load values provided by the wireless communication apparatus 136. For example, the second set of polished rod load values may be determined at the same sampling period of 50 milliseconds across a stroke cycle of the pumping unit 100. For example, the master timer 152 and/or the slave timer 142 may be used to set a sampling period and/or to substantially ensure data is obtained from the load sensor 134 and the secondary load sensor 160 at equal frequencies. Additionally, the processor 150 may employ the clock 159 to determine a time stamp at which each polished rod load value is received from the secondary load sensor 160. In some examples, the second set of polished rod load values is stored in the memory 158. In some examples, the master timer 152 and the slave timer 142 are synchronized (e.g., via the method 500 of FIG. 5) prior to initializing the calibration method 400.

Once the first and second polished load values are obtained, the processor 150 analyzes the first and second sets of polished rod load values (block 608). For example, the processor 150 may employ a comparator to compare the first set of polished rod load values and the second set of polished rod load values to determine which values are substantially equal or have similar values (e.g., within 1%). The processor 150 then compares the time stamps of equal or substantially similar polished rod load values of the first set of polished rod load values and the second set of polished rod load values. For example, an average time difference between each of the time stamps of the equal or substantially similar polished rod load values is determined or calculated. In some examples, the first and second sets of the polished rod load values are individually normalized so that the loads range from values between zero and one. The normalized data is then analyzed to determine an average phase shift between each of the readings. In some examples, the first and second sets of polished rod load values are converted to various dimensionless load threshold values (e.g., between 0.1 and 0.9) and interpolating all points from each dataset where the dimensionless load values cross these lines. The processor 150 sets the resulting phase shift (e.g., in seconds) as the wireless communication delay (TRL−TML) (block 610). In some examples, the wireless communication delay value is stored in the memory 158 for subsequent operation of the rod pump controller 138. After calibration is complete, the secondary load sensor 160 and the wired cable 162 is removed.

Figure 7:
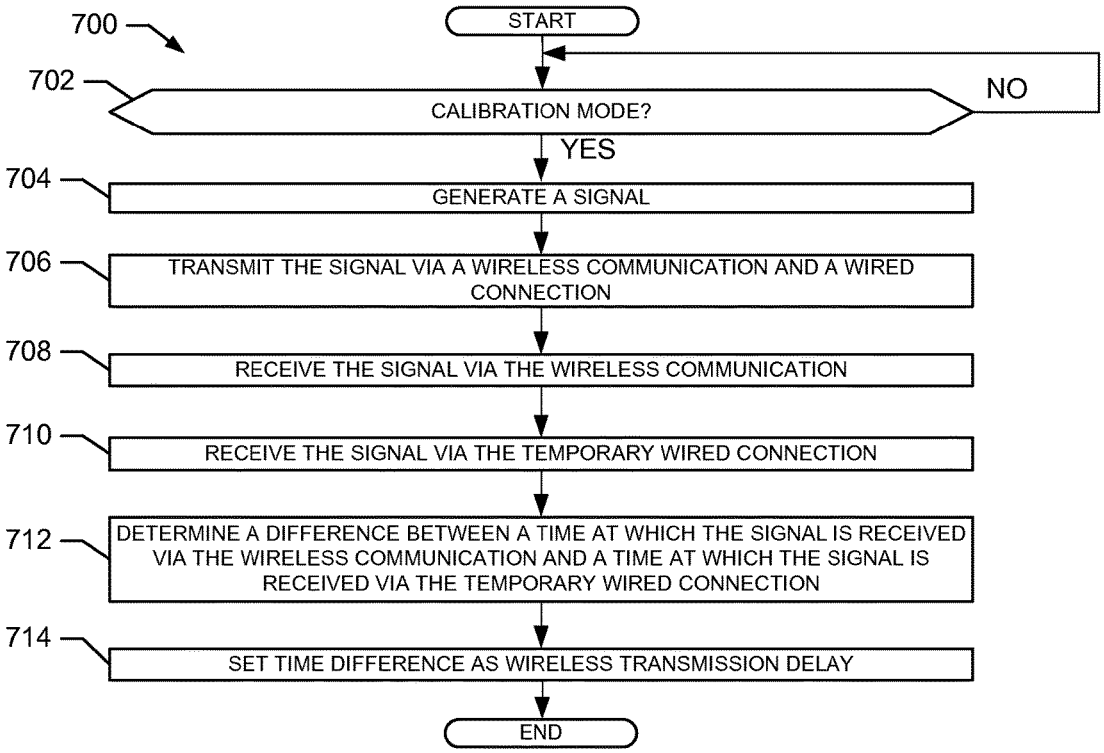

FIG. 7 illustrates another example method 700 of determining the wireless communication or transmission delay value in accordance with the teachings of this disclosure. The method 700 begins in a calibration preparation mode (block 702). The calibration mode may be initiated via a button on the rod pump controller 138 and/or the wireless communication device 136. In some examples, the calibration mode may be initiated via a calibration signal transmitted to the rod pump controller 138 and/or the wireless communication device 138. If the processor 150 determines that the rod pump controller 138 and/or the wireless communication apparatus 136 are not in calibration mode, the process returns to block 702. In the calibration mode, the wireless communication apparatus 136 generates a signal (block 704). In some examples, the signal may be a standard signal (e.g., a standard waveform signal such as, for example, 30-60 Hz sine wave, etc.). In some examples, the signal may be a signal provided by the load sensor 134 representative of a load measurement of the polished rod 110.

After the signal is generated, the wireless communication apparatus 136 transmits the signal (e.g., the same signal) via a wireless communication and a temporary wired connection (block 706). For example, the wireless communication apparatus 136 transmits the signal wirelessly via the transceiver 146 and transmits the signal via a temporary wired connection using the temporary wire 166. In turn, the rod pump controller 138 receives the signal via the wireless communication (block 708). For example, the rod pump controller 138 receives the signal transmitted from the transceiver 146 of the wireless communication apparatus 136 via the transceiver 156. In some examples, the processor 150 employs the clock 159 to time stamp the signal received by the wireless communication. Additionally, the rod pump controller 138 receives the signal via the temporary wired connection (block 710). For example, the processor 150 of the rod pump controller 138 receives the signal from the temporary wired connection via the I/O interface 154. In some examples, the processor 150 employs the clock 159 to time stamp the signal received by the temporary wired connection.

The processor 150 or, more generally, the rod pump controller 138 analyzes a difference between a time at which the signal is received via the wireless communication and a time at which the signal is received via the temporary wired connection (block 712). For example, the processor 150 or, more generally, the rod pump controller 138 may employ a comparator to compare and/or determine the difference between the time at which the signal was received via the wireless communication and the time at which the signal was received via the temporary wired connection. The rod pump controller 138 sets the time difference (e.g., in seconds) as the wireless communication delay (TRL−TML) (block 714). In some examples, the wireless communication delay value is stored in the memory 158 for subsequent operation of the rod pump controller 138. After calibration is complete, the wired cable 166 is removed.

Figure 8:
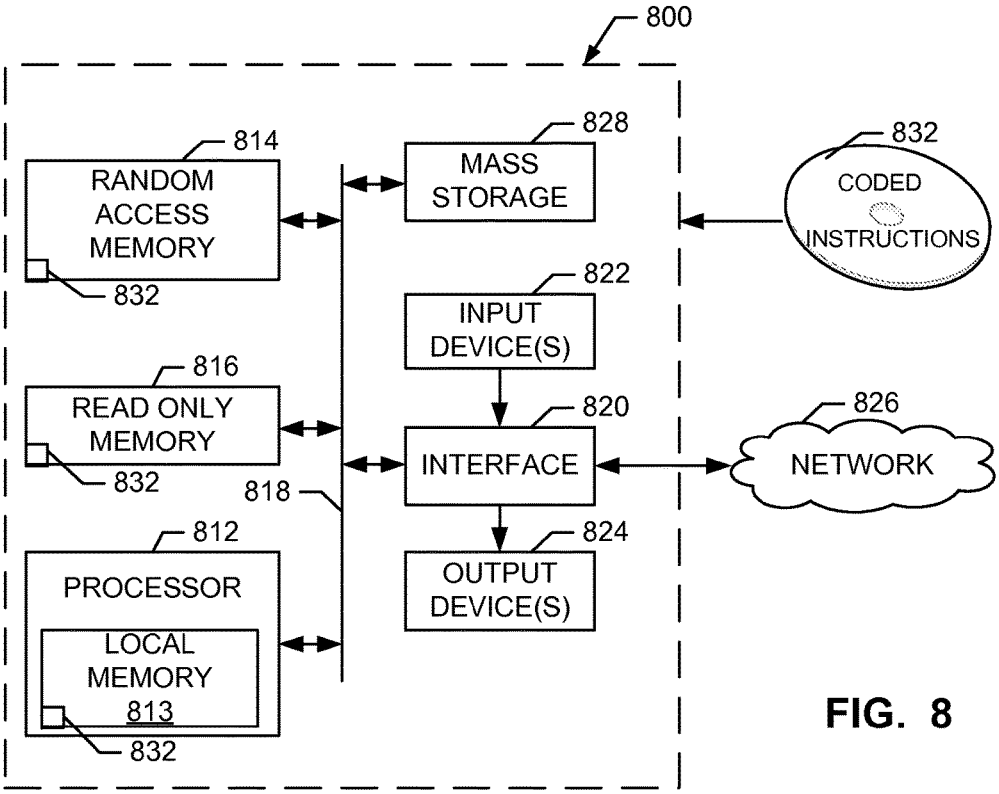
FIG. 8 is a processor platform to implement the methods of FIGS. 4-7 and/or the apparatus of FIG. 1.

FIG. 8 is a block diagram of an example processor platform 800 capable of executing the instructions to implement the methods of FIGS. 4-7 and/or the rod pump controller 138 and the wireless communication apparatus 136 of FIG. 1. The processor platform 800 can be, for example, a server, a personal computer, a mobile device (e.g., a cell phone, a smart phone, a tablet such as an iPad™), a personal digital assistant (PDA), an Internet appliance, or any other type of computing device.

The processor platform 800 of the illustrated example includes a processor 812. The processor 812 of the illustrated example is hardware. For example, the processor 812 can be implemented by one or more integrated circuits, logic circuits, microprocessors or controllers from any desired family or manufacturer.

The processor 812 of the illustrated example includes a local memory 813 (e.g., a cache). The processor 812 of the illustrated example is in communication with a main memory including a volatile memory 814 and a non-volatile memory 816 via a bus 818. The volatile memory 814 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 816 may be implemented by flash memory and/or any other desired type of memory device. Access to the main memory 814, 816 is controlled by a memory controller.

The processor platform 800 of the illustrated example also includes an interface circuit 820. The interface circuit 820 may be implemented by any type of interface standard, such as an Ethernet interface, a universal serial bus (USB), and/or a PCI express interface.

In the illustrated example, one or more input devices 822 are connected to the interface circuit 820. The input device(s) 822 permit(s) a user to enter data and commands into the processor 812. The input device(s) can be implemented by, for example, an audio sensor, a microphone, a keyboard, a button, a mouse, a touchscreen, a track-pad and/or a trackball.

One or more output devices 824 are also connected to the interface circuit 820 of the illustrated example. The output devices 824 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED). The interface circuit 820 of the illustrated example, thus, typically includes a graphics driver card, a graphics driver chip or a graphics driver processor.

The interface circuit 820 of the illustrated example also includes a communication device such as a transmitter, a receiver, a transceiver, a modem and/or network interface card to facilitate exchange of data with external machines (e.g., computing devices of any kind) via a network 826 (e.g., an Ethernet connection, a digital subscriber line (DSL), a telephone line, coaxial cable, a cellular telephone system, etc.).

The processor platform 800 of the illustrated example also includes one or more mass storage devices 828 for storing software and/or data. Examples of such mass storage devices 828 include floppy disk drives, hard drive disks, compact disk drives, Blu-ray disk drives, RAID systems, and digital versatile disk (DVD) drives.

Coded instructions 832 to implement the methods of FIGS. 4-8 may be stored in the mass storage device 828, in the volatile memory 814, in the non-volatile memory 816, and/or on a removable tangible computer readable storage medium such as a CD or DVD.

At least some of the aforementioned examples include one or more features and/or benefits including, but not limited to, the following:

In some examples, a method includes determining, via a rod pump controller, a first position value of a polished rod of a pumping unit; assigning a first time value to the first position value; receiving first load values of the polished rod; assigning second time values to respective ones of the first load values; adjusting each of the second time values to respective third time values based on a wireless communication delay value; and determining a second load value associated with the first position value at the first time value based on the first load values and the third time values.

In some examples, determining the second load value includes interpolating the second load value based on the first time value, the first load values, and the third time values.

In some examples, the method includes generating a reference table using the first position value, the first time value and the second load value.

In some examples, determining the wireless communication delay value includes determining a transmission delay between the rod pump controller and a wireless communication apparatus.

In some examples, determining transmission delay includes determining a time difference between receiving a first signal from a first load sensor provided by the wireless communication apparatus and a second signal from a second load sensor provided by a wired connection, the first signal and the second signal being representative of a load on the polished rod at a same time.

In some examples, determining transmission delay includes determining a time difference between receiving a signal provided by the wireless communication apparatus via a wireless communication and receiving the signal provided by the wireless communication apparatus via a wired connection.

In some examples, the method includes periodically broadcasting a synchronization signal to a wireless communication apparatus.

In some examples, the method includes resetting a master timer after broadcasting the synchronization signal.

In some examples, the method includes transmitting the first load values of the polished rod to the rod pump controller via the wireless communication apparatus.

In some examples, the method includes initiating a slave timer to an initial value and transmitting a measured load value of the first load values when the slave timer moves from an initial value to a zero value, the initial value being determined by a frequency at which the first load values of the polished rod are to be transmitted to the rod pump controller.

In some examples, the method includes determining a reset time stamp value when the wireless communication apparatus receives the synchronization signal.

In some examples, the method includes resetting the slave timer of the wireless communication apparatus to a value equivalent to initial value plus a difference between the initial value and the reset time stamp value.

In some examples, a rod pump controller for use with a pumping unit includes a first processor to: determine, via a rod pump controller, a first position value of a polished rod of a pumping unit; assign a first time value to the first position value; receive first load values of the polished rod; assign second time values to respective ones of the first load values; adjust each of the second time values to respective third time values based on a wireless communication delay value; and determine a second load value associated with the first position value at the first time value based on the first load values and the third time values.

In some examples, the processor interpolates the second load value based on the first time value, the first load values, and the third time.

In some examples, the first processor generates a reference table using the first position value, the first time value and the second load value.

In some examples, the rod pump controller includes a wireless communication apparatus to be communicatively coupled to the rod pump controller, the wireless communication apparatus to transmit the first load values of the polished rod to the pump rod controller.

In some examples, the first processor determines a transmission delay between the rod pump controller and the wireless communication apparatus to determine the wireless communication delay value during a calibration process.

In some examples, a second load sensor is communicatively coupled to the rod pump controller via a temporary wired connection during the calibration process, and the first processor determines a time difference between receiving a first signal from a first load sensor provided by the wireless communication apparatus and a second signal from the second load sensor provided by the temporary wired connection provided during the calibration process, the first signal and the second signal being representative of a load on the polished rod at a same time.

In some examples, the first processor determines the transmission delay value by determining a time difference between receiving a signal from via a wireless connection provided by the wireless communication apparatus and receiving the signal from the wireless communication apparatus via the temporary wired connection provided during the calibration process.

In some examples, the first processor is to periodically broadcast a synchronization signal to a wireless communication apparatus.

In some examples, the first processor resets a master timer after broadcasting the synchronization signal.

In some examples, a second processor of the wireless communication apparatus initiates a slave timer to an initial value and the second processor transmits a measured load value of the first load values when the slave timer moves from the initial value to a zero value, the initial value being determined by a frequency at which the first load values of the polished rod are to be transmitted to the rod pump controller.

In some examples, the second processor determines a reset time stamp value when the wireless communication apparatus receives the synchronization signal.

In some examples, the second processor resets the slave timer of the wireless communication apparatus to a reset value equivalent to the initial value plus a difference between the initial value and the reset time stamp value.

In some examples, a tangible computer-readable medium includes instructions that, when executed, cause a machine to: determine, via a rod pump controller, a first position value of a polished rod of a pumping unit; assign a first time value to the first position value; receive first load values of the polished rod; assign second time values to respective ones of the first load values; adjust each of the second time values to third time values based on a wireless communication delay value; and determine a second load values associated with the first position value at the first time value based on the first load values and the third time values.

In some examples, the computer-readable medium includes instructions that, when executed, cause the machine to interpolate the second load value based on the first time value, the first load values, and the third time.

In some examples, the computer-readable medium includes instructions that, when executed, cause the machine to generate a reference table using the first position value, the first time value and the second load value.

In some examples, the computer-readable medium includes instructions that, when executed, cause the machine to determine a time difference between receiving a first signal from a first load sensor provided by a wireless communication apparatus and a second signal from a second load sensor provided by a wired connection to determine the wireless communication delay value.

In some examples, the computer-readable medium includes instructions that, when executed, cause the machine to generate and transmit the first signal at a same instance as the second signal.

In some examples, the computer-readable medium includes instructions that, when executed, cause the machine to determine a time difference between receiving a signal from a wireless communication apparatus provided by a wireless communication and receiving the signal from the wireless communication apparatus provided by a wired connection to determine the wireless communication delay value.

In some examples, the computer-readable medium includes instructions that, when executed, cause the machine to periodically broadcast a synchronization signal.

In some examples, the computer-readable medium includes instructions that, when executed, cause the machine to reset a master timer after broadcasting the synchronization signal.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

monitoring, via a sensor communicatively coupled to a rod pump controller of a pumping unit, at least one of a rotational position of a crankarm or a number of revolutions of a motor of the pumping unit;

determining, via the rod pump controller, a first position value of a polished rod of the pumping unit based on the at least one of the rotational position of the crankarm or the number of revolutions of the motor;

assigning a first time value to the first position value;

receiving, via the rod pump controller communicatively coupled to a wireless communication apparatus of a load sensor coupled to the polished rod, first load values of the polished rod;

assigning second time values to respective ones of the first load values;

adjusting each of the second time values to respective third time values based on a wireless communication delay value of the wireless communication apparatus;

determining a second load value associated with the first position value at the first time value based on the first load values and the third time values;

correlating the second load value with the first position value to enable the rod pump controller to provide a pump dynamometer card; and operating the pumping unit based on the pump dynamometer card obtained using the second load value and the first position value.

2. The method of claim 1, wherein determining the second load value comprises interpolating the second load value based on the first time value, the first load values, and the third time values.

3. The method of claim 2, further comprising generating a reference table using the first position value, the first time value and the second load value.

4. The method of claim 1, wherein determining the wireless communication delay value comprises determining a transmission delay between the rod pump controller and the wireless communication apparatus.

5. The method of claim 4, wherein determining transmission delay comprises determining a time difference between receiving a first signal from a first load sensor provided by the wireless communication apparatus and a second signal from a second load sensor provided by a wired connection, the first signal and the second signal being representative of a load on the polished rod at a same time.

6. The method of claim 4, wherein determining transmission delay comprises determining a time difference between receiving a signal provided by the wireless communication apparatus via a wireless communication and receiving the signal provided by the wireless communication apparatus via a wired connection.

7. The method of claim 1, further comprising periodically broadcasting a synchronization signal to the wireless communication apparatus.

8. The method of claim 7, further comprising resetting a master timer after broadcasting the synchronization signal.

9. The method of claim 8, further comprising transmitting the first load values of the polished rod to the rod pump controller via the wireless communication apparatus.

10. The method of claim 9, further comprising initiating a slave timer to an initial value and transmitting a measured load value of the first load values when the slave timer moves from an initial value to a zero value, the initial value being determined by a frequency at which the first load values of the polished rod are to be transmitted to the rod pump controller.

11. The method of claim 10, further comprising determining a reset time stamp value when the wireless communication apparatus receives the synchronization signal.

12. The method of claim 11, further comprising resetting the slave timer of the wireless communication apparatus to a value equivalent to initial value plus a difference between the initial value and the reset time stamp value.

13. The method of claim 1, wherein determining the second load values includes assigning a respective one of the first load values as the second load value when the third time value of the respective one of the first load values is equal to the first time value associated with first position value.

14. A rod pump controller for use with a pumping unit, the rod pump controller comprising:

a first processor to:

monitor, via a sensor communicatively coupled to a rod pump controller of the pumping unit, at least one of a rotational position of a crankarm or a number of revolutions of a motor of the pumping unit;

determine, via the rod pump controller, a first position value of a polished rod of the pumping unit;

assign a first time value to the first position value;

receive first load values of the polished rod from a first load sensor via a wireless communication apparatus to be communicatively coupled to the rod pump controller;

assign second time values to respective ones of the first load values;

adjust each of the second time values to respective third time values based on a wireless communication delay value;

determine a second load value associated with the first position value at the first time value based on the first load values and the third time values;

correlate the second load value with the first position value to enable the rod pump controller to provide a pump dynamometer card; and operate the pumping unit based on the pump dynamometer card obtained using the second load value and the first position value.

15. The rod pump controller of claim 14, wherein the first processor interpolates the second load value based on the first time value, the first load values, and the third time.

16. The rod pump controller of claim 15, wherein the first processor generates a reference table using the first position value, the first time value and the second load value.

17. The rod pump controller of claim 14, further comprising the wireless communication apparatus, the wireless communication apparatus to transmit the first load values of the polished rod to the pump rod controller.

18. The rod pump controller of claim 17, wherein the first processor determines a transmission delay value between the rod pump controller and the wireless communication apparatus to determine the wireless communication delay value during a calibration process.

19. The rod pump controller of claim 18, further including a second load sensor communicatively coupled to the rod pump controller via a temporary wired connection during the calibration process, and wherein the first processor determines a time difference between receiving a first signal from the first load sensor provided by the wireless communication apparatus and a second signal from the second load sensor provided by the temporary wired connection provided during the calibration process, the first signal and the second signal being representative of a load on the polished rod at a same time.

20. The rod pump controller of claim 18, further including a temporary wired connection between the wireless communication apparatus and the rod pump controller during the calibration process, and wherein the first processor is to determine the transmission delay value by determining a time difference between receiving a signal from a wireless connection provided by the wireless communication apparatus and receiving the signal from the wireless communication apparatus via the temporary wired connection provided during the calibration process.

21. The rod pump controller of claim 14, wherein the first processor is to periodically broadcast a synchronization signal to the wireless communication apparatus.

22. The rod pump controller of claim 21, wherein the first processor resets a master timer after broadcasting the synchronization signal.

23. The rod pump controller of claim 22, wherein the wireless communication apparatus includes a second processor to initiate a slave timer to an initial value and transmit a measured load value of the first load values when the slave timer moves from the initial value to a zero value, the initial value being determined by a frequency at which the first load values of the polished rod are to be transmitted to the rod pump controller.

24. The rod pump controller of claim 23, wherein the second processor is to determine a reset time stamp value when the wireless communication apparatus receives the synchronization signal.

25. The rod pump controller of claim 24, wherein the second processor is to reset the slave timer of the wireless communication apparatus to a reset value equivalent to the initial value plus a difference between the initial value and the reset time stamp value.

26. The rod pump controller of claim 14, wherein the first processor assigns a respective one of the first load values as the second load value when the third time value of the respective one of the first load values is equal to the first time value associated with first position value.

27. A non-transitory machine readable medium comprising instructions that, when executed, cause a machine to:

monitor, via a sensor communicatively coupled to a rod pump controller of a pumping unit, at least one of a rotational position of a crankarm or a number of revolutions of a motor of the pumping unit;

determine, via the rod pump controller, a first position value of a polished rod of the pumping unit;

assign a first time value to the first position value;

receive first load values of the polished rod from a first load sensor via a wireless communication apparatus communicatively coupled to the rod pump controller;

assign second time values to respective ones of the first load values;

adjust each of the second time values to third time values based on a wireless communication delay value;

determine a second load values associated with the first position value at the first time value based on the first load values and the third time values;

correlate the second load value with the first position value to enable the rod pump controller to provide a pump dynamometer card; and operate the pumping unit based on the pump dynamometer card obtained using the second load value and the first position value.

28. The non-transitory machine readable medium as defined in claim 27 comprising instructions that, when executed, cause the machine to interpolate the second load value based on the first time value, the first load values, and the third time values.

29. The non-transitory machine readable medium as defined in claim 28 comprising instructions that, when executed, cause the machine to generate a reference table using the first position value, the first time value and the second load value.

30. The non-transitory machine readable medium as defined in claim 27 comprising instructions that, when executed, cause the machine to determine a time difference between receiving a first signal from the first load sensor provided by the wireless communication apparatus and a second signal from a second load sensor provided by a wired connection to determine the wireless communication delay value.

31. The non-transitory machine readable medium as defined in claim 30 comprising instructions that, when executed, cause the machine to generate and transmit the first signal at a same instance as the second signal.

32. The non-transitory machine readable medium as defined in claim 27 comprising instructions that, when executed, cause the machine to determine a time difference between a signal received from the wireless communication apparatus provided by a wireless communication and the signal received from the wireless communication apparatus provided by a wired connection to determine the wireless communication delay value.

33. The non-transitory machine readable medium as defined in claim 27 comprising instructions that, when executed, cause the machine to periodically broadcast a synchronization signal.

34. The non-transitory machine readable medium as defined in claim 27 comprising instructions that, when executed, cause the machine to reset a master timer after broadcasting the synchronization signal.

35. The non-transitory machine readable medium as defined in claim 27 comprising instructions that, when executed, cause the machine to assign a respective one of the first load values as the second load value when the third time value of the respective one of the first load values is equal to the first time value associated with first position value.

* * * * *